United States Patent [19]

Roman

[11] 4,448,355

[45] May 15, 1984

[54] WATERING PISTOL

[75] Inventor: Gianfranco Roman, Pasiano, Italy

[73] Assignee: Claber S.p.A., Fiume Veneto, Italy

[21] Appl. No.: 532,091

[22] Filed: Sep. 14, 1983

Related U.S. Application Data

[63] Continuation of Ser. No. 276,248, Jun. 22, 1981, abandoned.

[30] Foreign Application Priority Data

Jun. 23, 1980 [IT] Italy ..... 22101/80[U]

[51] Int. Cl.[3] ..... B05B 9/10

[52] U.S. Cl. ..... 239/526; 251/66; 251/245

[58] Field of Search ..... 239/525, 526, 583, 586; 222/402.14, 391; 251/66, 74, 245, 246, 244

[56] References Cited

U.S. PATENT DOCUMENTS

| | | | |
|---|---|---|---|
| 2,852,310 | 9/1958 | Francis | 239/526 |
| 3,006,560 | 10/1961 | Rosenkranz | 239/526 X |
| 3,093,318 | 6/1963 | Chow | 239/526 X |

FOREIGN PATENT DOCUMENTS

| | | | |
|---|---|---|---|
| 1558528 | 1/1969 | France | 239/583 |

*Primary Examiner*—John J. Love
*Assistant Examiner*—Paul A. Sobel
*Attorney, Agent, or Firm*—Diller, Ramik & Wight

[57] ABSTRACT

A pistol for dispensing a watering liquid to plants and the like has a crenellated pistol grip portion, the crenellations whereof are a latching member for a swinging pawl which is actuated by a handle, an upper projecting portion of said handle having also toothed members and a resilient nature so as to engage corresponding latching portions of a shutter stem adapted to throttle the water jet emerging from said pistol and straighten it.

7 Claims, 2 Drawing Figures

Figures 1, 2:
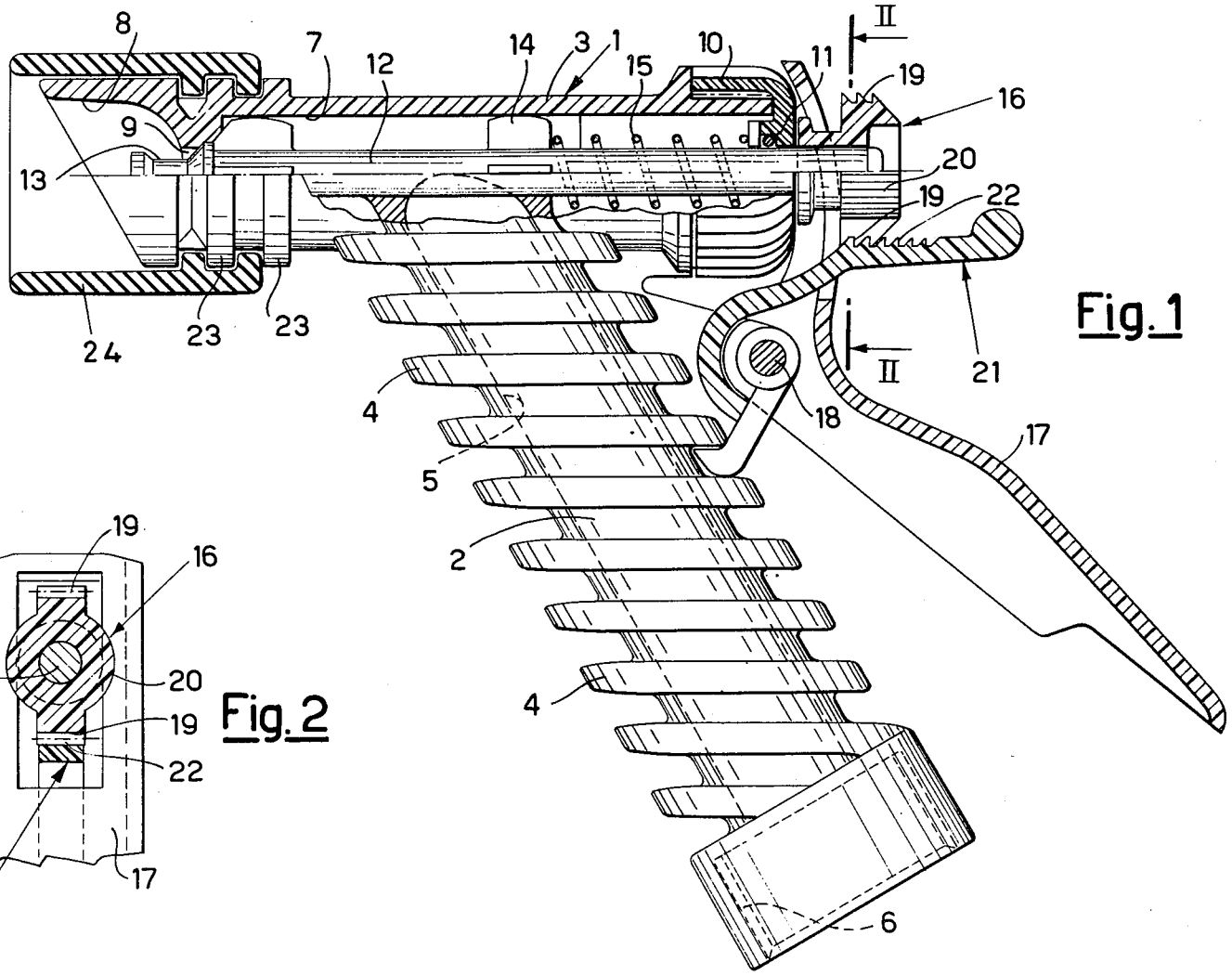

II
II
1
2
3
4
4
5
6
7
8
9
10
11
12
12
13
14
15
16
16
17
17
18
19
19
19
20
20
21
21
22
22
23
23
24

WATERING PISTOL

This application is a continuation of application Ser. No. 276,248, filed June 22, 1981 now abandoned.

This invention relates to a watering pistol which possesses an original system for adjusting the emerging water stream.

The pistol according to the invention, which is comprised of a shutter member integral with a stem that can be displaced axially by a control handle, is characterized in that said stem has, secured thereto, a hooked pawl member which can be releasably be engaged into selectable positions with a likewise toothed latching member so as to define opening positions of said shutter member.

By properly selecting the position of engagement between the pawl and the latching member it becomes thus possible to set at leisure a stable position of the shutter member and consequently a desired rate of flow for the watering liquor.

The latching member referred to above is preferably comprised of a leaf spring which is resiliently urged towards the engagement with the toothed pawl, but can, however, be cleared thereof by an appropriate control. It becomes thus comparatively simple to release the pawl, and thus the shutter member, from the latching position which has previously been selected and thus the stream of dispensed liquor can be cut of or merely modified.

In its turn, the toothed pawl has, preferably, at least one toothed sector and at least one substantially smooth sector angularly shifted with respect thereto and is secured to said stem so as to be able to be rotated about its own axis. This fact make possible to disengage the toothed pawl from the latching member completely so as to clear the shutter member from any preset engagement and to render it directly controllable by the handle.

The features of the present invention will become still more clear from the ensuing detailed description of a possible embodiment thereof as illustrated by way of example only in the accompanying drawing, wherein:

FIG. 1 shows a pistol according to the invention in side elevational view with a few members in cross-sectional view, and FIG. 2 shows a detail of said pistol in cross-sectional view, taken along the line II—II of FIG. 1.

The pistol shown in the drawing has a plastics material external casing 1 composed of a lower section 2 and an upper section 3, made as a single entity. The bottom portion 2 provides for an array of circular parallel ribs 4 and has a conduit 5 formed axially therethrough and opening into a screw-threaded fitting 6 intended for the connection to an appropriate feeding hose for the watering liquor (usually plain water).

The top portion 3, also having circular ribs 23, parallel to each other and capable of engaging a shielding muzzle 24 has, in its turn, an axial conduit 7 running therethrough which freely communicates with the aforementioned duct 5 of the bottom section 2 and is terminated at either end by a dispensing spout 8 through a restricted passageway 9.

The other end of the conduit 7, conversely, is closed by a screw cap 10 through which a stem 12 is caused axially to slide (the tight seal being provided by a gasket 11), said stem being connected to a shutter member 13 intended to close and to open the restricted passageway 9. The stem 12 is guided in its axial sliding motion by a set of radial fins 14, while a spring 15 provides to hold it in an advanced position wherein the shutter member 13 shuts the restricted passageway 9 thus preventing any liquid feed through the fitting 6 and the conduit 5.

Externally of the plug 10, the stem 12 has, secured thereto, for rotation, a manipulation pawl 16 which cooperates with a control handle 17 pivoted at 18 to the bottom section 2 of the casing 1.

The pawl 16 has two diametrically opposite toothed sectors 19, separated by two substantially smooth sectors, or, better to speak, knurled sectors, 20. By either crenellated sector 19, it is possible to latch in any desired position the pawl 16 to a leaf spring 21 of a plastics material, which is equipped with the matching teeth 22 and which is fastened to the outer casing 1 and is resiliently biased towards the releasable engagement with the pawl 16.

In FIG. 1, the pistol has been shown in the position of cutoff, with the shutter member 13 biased by the spring 15 into the cutoff position of the restricted passageway 9.

To select any position of stable feed, it is enough to act upon the handle 17 so as to push the stem 12 backward and consequently also the shutter member 13 to the desired degree.

The position which has been attained remains stably set by the mutual engagement between a toothed sector 19 of the pawl 16 and the corresponding crenellations 22 of the leaf spring 21.

The shutter member 13, on the other hand, can easily be brought back to its cutoff position by manually acting upon the leaf spring 21 so as to undo its engagement with the pawl 16, so that the spring 15 can newly push the stem 12 ahead again.

By rotating the pawl 16 angularly through 90° it becomes possible completely to disengage the pawl 16 from the leaf spring 21 so as to permit the regulation at choice of the emerging liquid stream by means of the handle 17.

It should be noted that the flow of the dispensed liquid is not only governed by the position of the stem 12, but also straightened by the radial noses 14 thereof, These noses have thus also that additional important function in addition to that of centering and guiding the sliding motion of the stem 12.

It should also be emphasized that the circular and parallel ribs 4 equipping the lower portion 2 of the pistol casing have a function which is not merely of embellishment. These ribs, in fact, permits to impart thickness, stiffness and solidity to the portion of pistol grip which otherwise, especially for its being of a plastics material, would take, of necessity a slender thickness and cross-sectional dimension to the expenses of sturdiness. In addition to beng reinforced, the pistol grip 2 takes also such a size that it can be grasped easily and reliably in very much an anatomically correct way.

I claim:

1. A pistol-grip, liquid-dispensing device comprising: a casing having an internal conduit terminating in a dispensing spout; an axially movable stem located in said conduit and carrying at one end a shutter member for opening and closing said spout upon axial movement of said stem in opposite directions, means for spring biasing said stem toward a closed position, said stem having an opposite end located outside said casing; and operating handle cooperating with said stem opposite end for imparting axial movement thereto in a direction to open said spout; and a latching device for releasably latching said stem in preselected spout-open positions, said latching device including a pawl member and a toothed rack member biased toward engagement with each other, one of said members being fixed to and rotatably movable with said stem opposite end outside of said casing and the other of said members being fixed to and deflectably carried by said casing adjacent said stem opposite end and selectively engageable with said one member outside of said casing.

2. The liquid dispensing device as defined in claim 1 wherein said handle includes opening means for receipt therethrough of said stem opposite end, said one member and said other member.

3. The liquid dispensing device as defined in claim 1 wherein said handle includes opening means for receipt therethrough of said stem opposite end, said one member and said other member, said opening means being formed in an end portion of said handle, and said handle end portion being held in sandwiched relationship between said one member and an abutment carried by said stem.

4. The liquid dispensing device as defined in claim 1 wherein said handle includes opening means for receipt therethrough of said stem opposite end, said one member and said other member; said other member being said toothed rack member disposed in cantilevered relationship to said casing and having a plurality of upwardly directed ratchet teeth, and said pawl member having at least one downwardly directed ratchet tooth selectively engageable with said teeth.

5. The liquid dispensing device as defined in claim 2 wherein said tooth and teeth have oppositely directed inclined flank surfaces disposed to automatically ride upon each other toward a position of disengagement upon said handle being moved to move said stem in a direction for opening said shutter member.

6. Pistol according to claim 1, characterized in that said stem has radial ribs for centering and guiding said stem so as to straighten the emerging liquid stream.

7. Pistol according to claim 1, characterized in that it has a casing with a gripping portion having parallel cross ribs.

* * * * *